US006213434B1

(12) United States Patent
Reichanadter, Jr.

(10) Patent No.: US 6,213,434 B1
(45) Date of Patent: Apr. 10, 2001

(54) TELESCOPICALLY MOVEABLE AND ADJUSTABLE RACK

(75) Inventor: Larry Reichanadter, Jr., Niles, MI (US)

(73) Assignee: Garden City Products, Inc., Niles, MI (US)

( * ) Notice: Subject to any disclaimer, the term of this patent is extended or adjusted under 35 U.S.C. 154(b) by 0 days.

(21) Appl. No.: 09/276,162

(22) Filed: Mar. 25, 1999

(51) Int. Cl.[7] ..... A47F 5/00

(52) U.S. Cl. ..... 248/125.8; 248/412; 211/207

(58) Field of Search ..... 248/125.8, 161, 248/410, 412, 404, 421, 354.1, 413; 403/109.5, 109.7, 109.2, 104; 211/207, 204, 206, 205, 196; 297/344.12, 344.18, 440.24; 108/146

(56) References Cited

U.S. PATENT DOCUMENTS

| | | | | |
|---|---|---|---|---|
| 389,005 | * | 9/1888 | Peck | 211/207 |
| 430,392 | * | 6/1890 | Maschmeyer | 248/412 |
| 1,048,143 | * | 12/1912 | Franke | 248/414 |
| 2,415,663 | | 2/1947 | Vitek | 297/344.18 |
| 2,787,485 | * | 4/1957 | Frisell | 248/412 |
| 2,892,647 | | 6/1959 | O'Neill | 248/354.1 |
| 2,952,485 | | 9/1960 | Hammond et al. | 403/105 |
| 3,807,574 | * | 4/1974 | Lanza | 211/207 |
| 3,835,486 | | 9/1974 | Benoit et al. | 5/503.1 |
| 4,239,169 | * | 12/1980 | DeSantis | 248/412 |
| 4,892,279 | | 1/1990 | Lafferty et al. | 248/125.8 |
| 5,016,846 | | 5/1991 | Solomon | 248/161 |

* cited by examiner

*Primary Examiner*—Leslie A. Braun
*Assistant Examiner*—Gwendolyn Baxter
(74) *Attorney, Agent, or Firm*—Baker & Daniels

(57) ABSTRACT

A mechanical stand for vertically supporting objects is disclosed which includes an upper base section comprised of a tubular structure, having a telescopically movable upper support member, which in the preferred embodiment of the invention could be used as a rack member or a shelf structure. The upper support member is comprised of a tubular member cooperatively profile with the tubular structure of the upper base section to be slidably received therein. The upper support member includes a pushbutton actuator which is operatively connected to a linkage member, which in turn is connected to a locking jaw, whereby actuation of the pushbutton member disengages the locking jaw from the inner surface of the upper base member, allowing various incremental telescopic locations of the upper support member.

16 Claims, 4 Drawing Sheets

TELESCOPICALLY MOVEABLE AND ADJUSTABLE RACK

BACKGROUND OF THE INVENTION

1. Field of the Invention

The field of the invention is related to telescopically extendable, vertical weight bearing members, and more particularly to a vertical holding member such as for clothing or garments.

2. Prior Art

It is common in the clothing industry to have a plurality of racks arranged in various areas with clothes such as shirt, pants and coats arranged on opposite sides of the clothing rack. Generally these racks are comprised of tubular structural members which upstand from the floor and include adjustable means such as a spring-loaded pin which can be depressed to move an upper bracket upwardly or downwardly to another pre-drilled aperture in an outside tubular structure to main the rack in a predetermined position.

While not specifically disclosed for such an application, U.S. Pat. Nos. 2,892,647; 2,952,485 and 2,415,663 show various mechanisms for retaining a structural upper section relative to a support portion which is typically sitting on the floor. U.S. Pat. No. 5,016,846 also shows a device for a hospital table.

What is desired in the marketplace, is a vertically adjustable support member, which can be telescopically movable to infinite incremental positions, yet is simple in construction, has the ability to maintain a great deal of vertical load, and is easily adjustable between the various vertical heights.

SUMMARY OF THE INVENTION

The objects of the invention have been accomplished by providing a mechanical stand assembly for supporting objects, where the stand comprises an upper base section and a support member. The support member includes a telescopic tube projecting therefrom and within the upper base section and further comprises a locking mechanism for maintaining the support member at various incremental heights. The locking mechanism includes a locking jaw which is pivotably mounted within the stand, and has a frictional surface for engagement with a locking surface within the upper base section. The locking jaw and the locking surface are vertically offset so as to form an over center locking arrangement when downward vertical force is applied to the support member, yet with free upward vertical movement to adjust the vertical height.

In another aspect of the invention, the objects were accomplished by providing a mechanical stand assembly for supporting objects, where the stand comprises an upper base section, a support member, and an actuator assembly. The support member is cooperably attached to the upper base section allowing vertical movement there between. The actuator assembly comprises a locking member which is mounted to the stand assembly and which fixes the support member in various vertical positions, and an actuator member which moves the jaw into and out of locked engagement, thereby allowing for an infinite number of incremental vertical height positions for the support member.

DETAILED DESCRIPTION OF THE PREFERRED EMBODIMENTS

Figure 1:
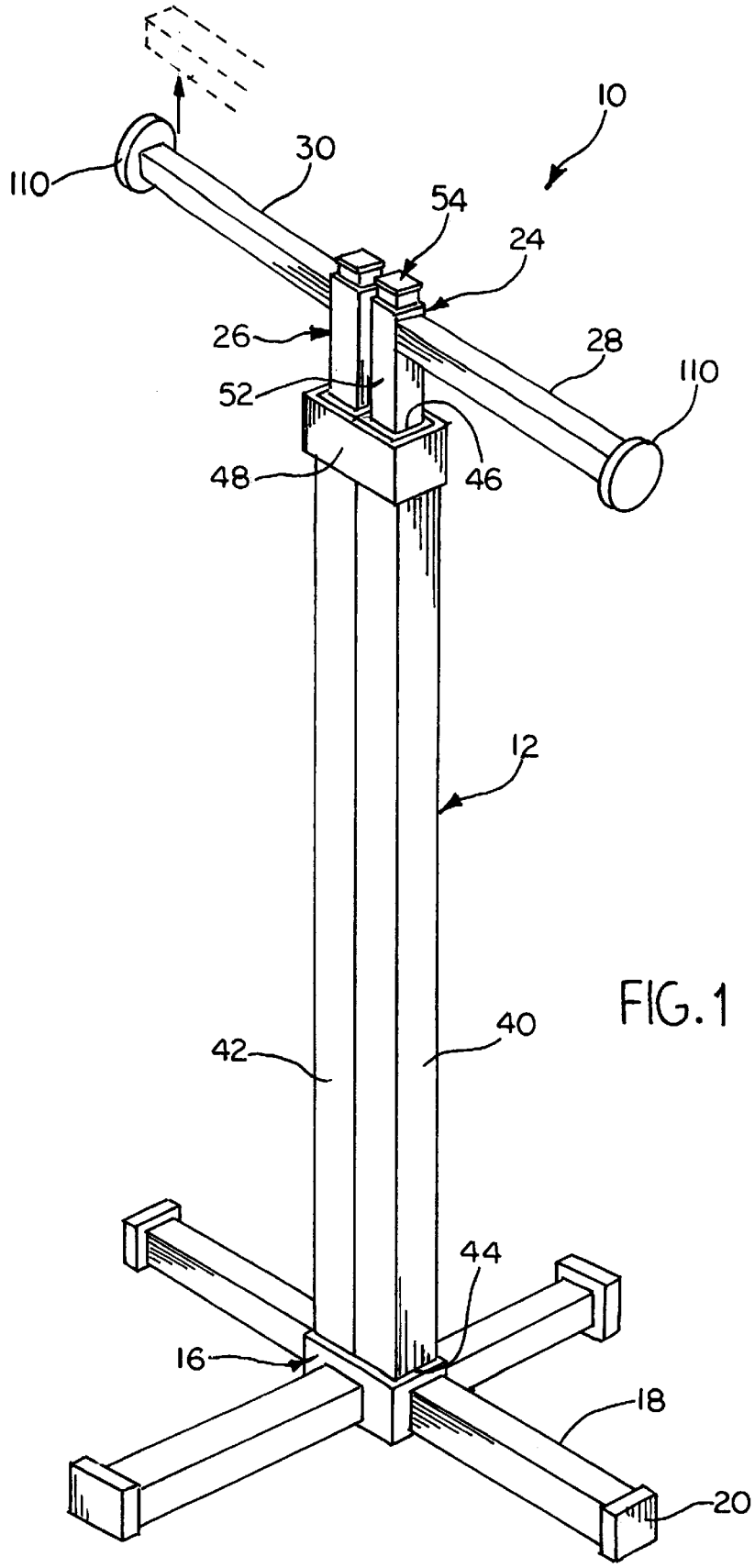
FIG. 1 is a three-dimensional perspective view of a typical double-sided rack, which could be used for hanging clothing articles for display purposes.

With reference first to FIG. 1, the clothing rack assembly is shown generally by reference 10 as including a base section 12, which upstands from a lower base section or floor support member, shown generally at 16, which is used to stabilize the clothing rack assembly 10 in the vertically upright position. It should be appreciated that the floor support member 16, could include any configuration of a base, but as depicted herein, is comprised of a plurality of individual floor feet sections, shown at 18, having floor pad sections 20. The clothing rack assembly 10 further includes independently movable upper support members such as 24 and 26, which include bracket support members 28 and 30.

Figure 2:
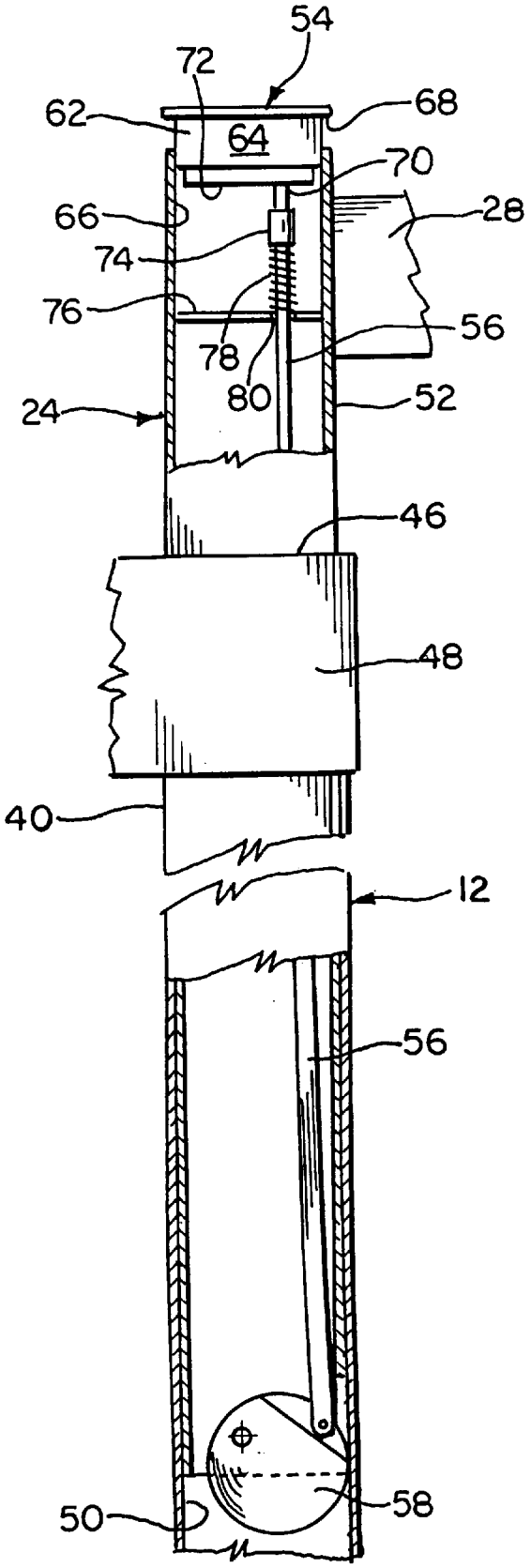
FIG. 2 is a side view of the rack shown in FIG. 1, partially broken away, where the upper section is shown in the locked position.

With respect now to FIGS. 1 and 2, the upper base section 12 and upper support member 24, 26 will be described in greater detail. The upper base member 12 is comprised of two side by side tubular members 40 and 42 which are identical in nature, and therefore only one such article will be described in detail. The tubular member 40 is preferably constructed from a metal extruded member such as a rectangular tube and includes a lower end section at 44 which can be attached to the floor base section 16 by known means such as through fasteners, brackets or by a welded structure. At the opposite end of the tubular member 40 is an opening 46 profiled to receive one of the upper support members such as 26, as will be described in further detail herein. Finally, the upper base section 40 includes an inner contour such as at 50 which is profiled to slidably receive either of the upper base members 24 or 26, as will be described in greater detail herein. The upper base member 12 further includes a strap or band section 48 to rigidify the two tubular members 40 and 42 together.

With respect now to FIG. 2, the upper support member such as 24 will be described in greater detail. It should be understood that as both members 24 and 26 are identical, only one such devise will be described. As shown in FIG. 2, the upper support member 24 is comprised of a tubular section 52, an upper pushbutton actuator 54, a linkage member 56, and a locking jaw 58. Extending from the upper support member 24 is the lateral support bar 28, as described above to hang garments.

With respect now to the linkage mechanism, the pushbutton member 54, is comprised of a body member 62 having an outer peripheral surface 64 profiled to be received within an inner contour 66 of the tubular column, with an upper lip 68 to prevent over-actuation of the pushbutton actuator 54. The pushbutton actuator 54 further includes an opening at 70 extending upwardly through a lower face 72 of the pushbutton member, which is profiled to receive the linkage rod 56. It should be appreciated to one of ordinary skill in the art that the pushbutton actuator and the linkage member could be attached by known means, such as by threading or by press-fit or through an epoxy.

Meanwhile, the linkage rod 56 includes a press or sweat fit collar at 74 which is opposed from a fixed inner wall 76 having a compression spring 78 positioned between the collar 74 and the inner wall 76. It should also be appreciated that an aperture is positioned at 80 through the inner wall 76 allowing the uninhibited extension and movement of the linkage rod through the upper plate 76. As should be appreciated, the compression spring 78 spring-loads the collar 74 upwardly, and therefore the linkage rod 56 and resultantly, the push-button actuator 54, are in a normally spring-loaded position upwardly.

Figure 3:
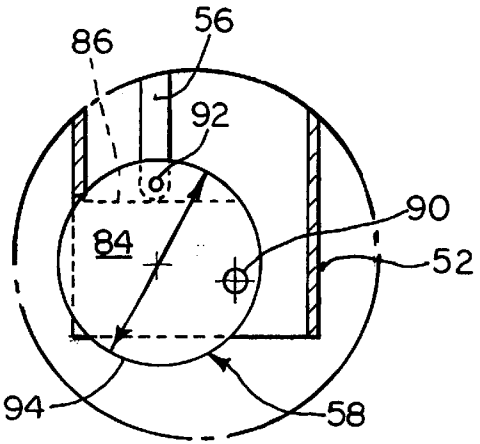
FIG. 3 is an enlarged view of the locking mechanism shown when in the fully open uninhibited position.
Figure 4:
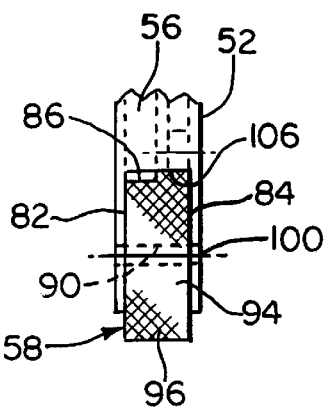
FIG. 4 is a side view of the locking mechanism shown in FIG. 3

With reference now to FIGS. 3–6, the locking jaw 58 is shown as a metallic cylindrical shaped member, having side surfaces 82 and 84, where a reduced thickness section 86 is provided to received the linkage rod 56 as will be described herein. The locking jaw 58 further includes a pin-receiving aperture at 90 and a further pin-receiving aperture at 92. Preferably, the outer circumferential surface 94 of the locking jaw is proved with a frictional surface and in the preferred embodiment of the invention, has been knurled as at 96 and has been hardened through a subsequent heat-treating process. For ease of process, in the preferred embodiment of the invention, the entire circumferential surface is knurled. As shown in FIG. 3, assembly of the locking jaw 58 to the tube member is as follows.

The locking jaw 58 is attached to an inner section of the tube member 52 by way of a spring point 98, which is interferingly positioned through apertures 100 in the tube member 52. It should be appreciated that opposite ends of the sporing pin 98 will be interferingly fit in apertures 100 in opposite sides of the tube member 52, yet will be profiled relative to the aperture 90 on the locking jaw, to allow the locking jaw to freely rotate about the pin member 98. The linkage rod 56 extends through the entire length of the tube member 52 and includes a lower end section at 104 having a pin member 102 which is interference fit within aperture 92 of the locking jaw 58. Once again, it should be understood that the pin 102 be profiled to allow rotation of the linkage rod relative to the pin yet be interference fit within the aperture 92 of the locking jaw 58. This could be accomplished by a number of means known within the art, that is by including an interference fit pin member having an outer head which is larger than the aperture at the end of the linkage rod, or could include a threaded member including a headed section to retain the linkage rod 56 to the locking jaw 58. As shown, a peripheral section 94 of the locking jaw 58 is positioned adjacent to an opening 106 in the tubular member 52 so it can be moved from a position extending outside the periphery of the tubular member 52, (FIG. 3) to a position extending inside the tubular member 52 by way of actuation of the pushbutton actuator 54 (FIG. 6).

Figure 5:
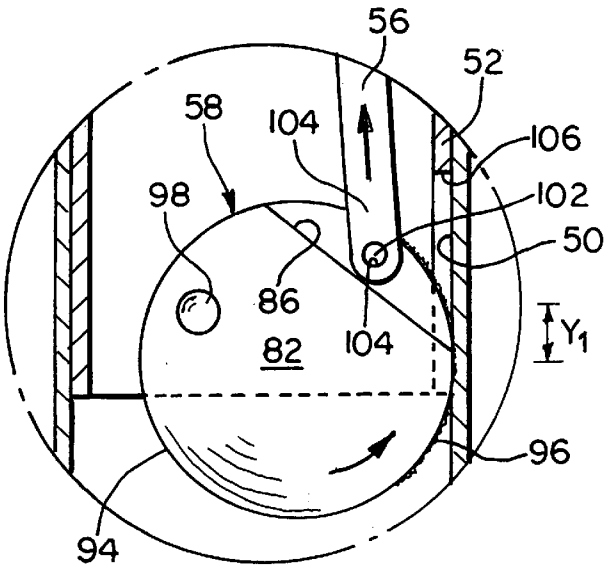
FIG. 5 is an enlarged view of the locking mechanism when in the locked position.
Figure 6:
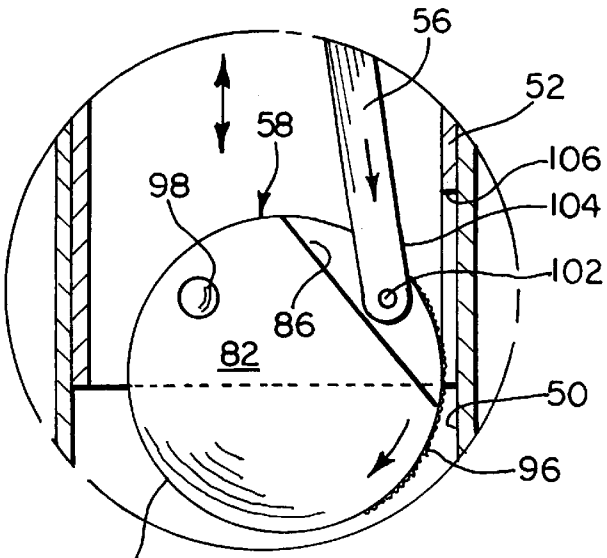
FIG. 6 is an enlarged view of the locking mechanism shown when in an unlocked position.

With reference now to FIGS. 5 and 6, the operation of the telescopic device will be described in greater detail. With respect first to the open position shown in FIG. 6, it should be appreciated that with the push-button actuator 54 in the activated state, that is when the push-button is engaged such that the linkage rod 56 is fully extended, the locking jaw 58 rotates in a clockwise sense about the pivot pin 98 as viewed in the position of FIG. 4. It should be appreciated that the locking jaw 58, in this position, is not in engagement with the inside wall 50 of the outer tube member 40 and therefore due to the sliding fit between the inner and outer tubular members, 40 and 52, of the upper support member and the vertical base portion 40, the upper support member 26 can be moved to virtually any incremental vertical position telescopically, only being limited by the overlapping length of the tubular members 40 and 52. However, with reference to FIG. 5, when the pushbutton 54 is disengaged, that is when the spring is allowed to move the pushbutton upwardly, thereby retracting the linkage rod 56 also upwardly, the locking jaw 58 rotates in a counter-clockwise sense, thereby bringing the outer peripheral surface 96 into engagement with the inner surface 50 of the outer tubular member 40. It should be appreciated that due to the over-centered nature of the pin 98 and frictional engagement contact surface, that is the offset Y1, (FIG. 5) a downward vertical load on the bracket 28, will cause the locking jaw 58 to tend to bite in further into the inner surface 50 thereby tightening the inner 52 and outer 40 tubular members together. It should be appreciated that the device as shown herein, shows an easy mechanism for adjusting the height of such support structures which can be moved through any virtual incremental number of vertical locations.

Figure 7:
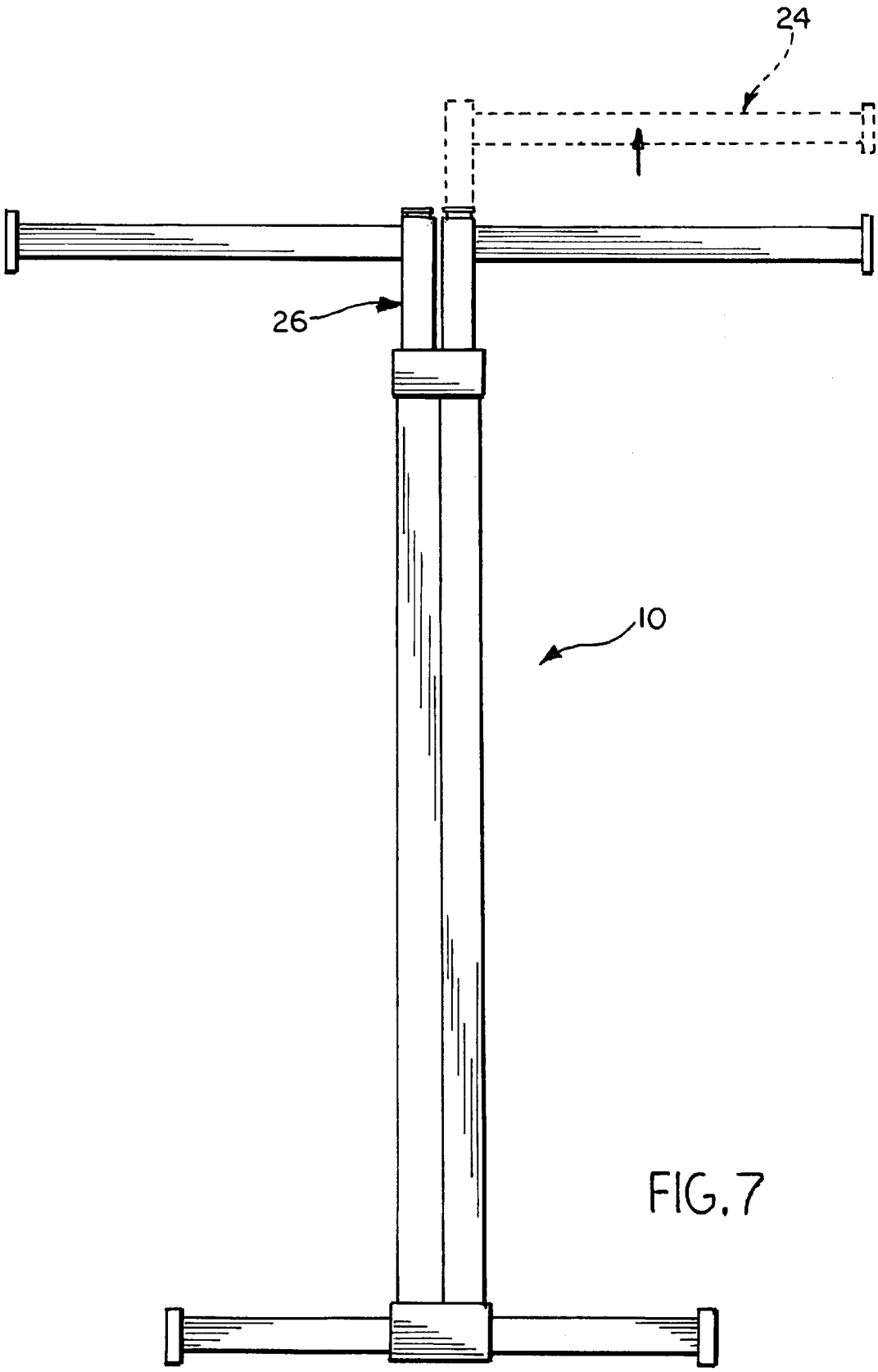
FIG. 7 is a side-view of a clothing rack showing the bracket sections at different vertical heights.

Also advantageously, shown in FIG. 7, the rack of the present invention can be positioned at different vertical heights for different articles of clothing, for example one side could be at one vertical height for such clothing articles as topcoats or raincoats while the opposite side could be used for short jackets, or shirts. So is the case even when fully loaded, as the actuator 54 is easily accessible to the user. The user can simply grasp the support member 24 with one hand, and depress the button 54, and move the support member 54 upwardly or downwardly as is required for the display. To ensure that the hangers, and the clothing which they hold, does not slip off the brackets 28, end caps 110 prevent such slippage.

What is claimed is:

1. A mechanical stand assembly for supporting objects, said stand comprising an upper base section and a support member, said support member including a telescopic tube projecting therefrom and within said upper base section and further comprising a locking mechanism of maintaining said support member at various incremental heights, said locking mechanism including a locking jaw having a pivot connection within said telescopic tube, and having a frictional surface for engagement with a locking surface within said upper base section, said pivot connection and said locking surface being vertically offset so as to form an over center locking arrangement when downward vertical force is applied to said support member, and with free upward vertical movement to adjust the vertical height of said support member, and an actuator member allowing said locking jaw to be engaged and disengaged from said locking surface while said telescopic tube is at any height and has moved in either the upwards or downwards direction.

2. The stand assembly of claim 1, wherein said telescopic tube is substantially rectangular in cross section, and said upper base section is of complementary cross section allowing movement of said telescopic tube within said upper base section.

3. The stand assembly of claim 2, wherein said locking jaw is mounted interiorly of said telescopic tube, and has an arcuate surface carrying said friction surface, said friction surface being located exterior of an outer periphery of said telescopic tube.

4. The stand assembly of claim 3, wherein a horizontal centerline through the point of engagement of said frictional surface and said upper base section is below a horizontal centerline through said pivot connection.

5. The stand assembly of claim 1, wherein said actuator member has a first end operatively connected to said locking jaw and a second end operable from a position exterior of said base section and support member, so as to increase said vertical offset and being operable between a position where said frictional surface is disengaged, allowing free vertical movement of said support member, to a locked position where said frictional surface is fully engaged with said upper base portion and is in a vertically locked position.

6. The stand assembly of claim 1, further comprising a lower base section which allows said assembly to be free standing on a horizontal surface.

7. A mechanical stand assembly for supporting objects, said stand comprising an upper base section, a support member, and an actuator assembly, said support member being cooperably attached to said upper base section allowing vertical movement there between, said actuator assembly comprising a locking member which is pivotally mounted to said stand assembly and which fixes said support member in various vertical positions, and an actuator member which moves said locking member into and out of locked position, thereby allowing for an infinite number of incremental vertical height positions for said support member, said actuator member having a first end connected to said locking member and a second end operable from a position exterior of said base section and support member, so as to increase said vertical offset, and being operable between a position where said frictional surface is disengaged, allowing free vertical movement of said support member, to a locked potion where said frictional surface is fully engaged with said upper base portion and is in a vertically locked position.

8. The stand assembly of claim 7, wherein said support member includes a telescopic tube projecting therefrom and within said upper base section.

9. The stand assembly of claim 8, wherein said locking member comprises an over center locking jaw mounted to said telescopic tube, and said locking jaw engages an inner surface of said upper base section when in a locked position.

10. The stand assembly of claim 13, wherein said telescopic tube is substantially rectangular in cross section, and said upper base section is of complementary cross section allowing movement of said telescopic tube within said upper base section.

11. The stand assembly of claim 10, wherein said locking jaw is mounted interiorly of said telescopic tube, and has an arcuate friction surface, said friction surface being located exterior of an outer periphery of said telescopic tube.

12. The stand assembly of claim 11, wherein a horizontal centerline through the point of engagement of said frictional surface and said upper base section is below a horizontal centerline through said pivot point of said locking member.

13. The stand assembly of claim 7, wherein said support member comprises telescopic tube member projecting downwardly therefrom, and into said upper base section.

14. The stand assembly of claim 13, wherein said locking member comprises an over center locking jaw mounted substantially within said telescopic tube, with the exception of an arcuate frictional surface which extends exteriorly of said tube and engages an inner surface of said upper base section when in a locked position.

15. The stand assembly of claim 14, wherein said actuator assembly further comprises a spring loaded pushbutton operatively connected to a link rod which in turn is operatively connected to said locking jaw, whereby depression of said pushbutton moves said frictional surface out of engagement with said upper base section.

16. The stand assembly of claim 15, wherein said pushbutton is mounted to an upper end of said upper base section, and said locking jaw is mounted at an opposite end, with said link rod extending through said tube.

* * * * *